US010337342B2

(12) United States Patent
Rawlinson

(10) Patent No.: US 10,337,342 B2
(45) Date of Patent: Jul. 2, 2019

(54) STATOR ASSEMBLY FOR A GAS TURBINE ENGINE

(71) Applicant: ROLLS-ROYCE plc, London (GB)

(72) Inventor: Anthony J. Rawlinson, Derby (GB)

(73) Assignee: ROLLS-ROYCE plc, London (GB)

( * ) Notice: Subject to any disclaimer, the term of this patent is extended or adjusted under 35 U.S.C. 154(b) by 98 days.

(21) Appl. No.: 15/705,804

(22) Filed: Sep. 15, 2017

(65) Prior Publication Data

US 2018/0100403 A1 Apr. 12, 2018

(30) Foreign Application Priority Data

Oct. 6, 2016 (GB) ..... 1616969.0

(51) Int. Cl.
*F01D 9/04* (2006.01)
*F01D 5/08* (2006.01)
*F01D 5/30* (2006.01)

(52) U.S. Cl.
CPC ..... *F01D 9/044* (2013.01); *F01D 5/081* (2013.01); *F01D 5/303* (2013.01); *F01D 5/3061* (2013.01);

(Continued)

(58) Field of Classification Search
CPC ..... F01D 9/042; F01D 9/044; F01D 5/081; F05D 2240/12

(Continued)

(56) References Cited

U.S. PATENT DOCUMENTS 5,332,360 A 7/1994 Correia et al.
2009/0110552 A1* 4/2009 Anderson ..... F01D 5/005 415/209.3

(Continued)

FOREIGN PATENT DOCUMENTS

EP 2612998 A2 7/2013
EP 2728121 A2 5/2014
WO 2016/121163 A1 8/2016

OTHER PUBLICATIONS

Jan. 25, 2017 Search Report Issued in British Patent Application No. GB1616969.0.

(Continued)

*Primary Examiner* — Erick R Solis
(74) *Attorney, Agent, or Firm* — Oliff PLC

(57) ABSTRACT

A stator assembly comprises an annular platform (1) defining a boundary of an annulus and a plurality of guide vanes (2) for arranging in a circumferential array on the annular platform (1). The platform (1) includes a circumferential array of slots each slot having, at a first end, walls converging (3) from an annulus facing side towards an opposite side of the platform and then extending parallel (4) towards a second end. One or more cooling holes (5) is arranged in a wall (3,4) of the slot. Each vane (2) includes a root portion (7) which converges in a first region (8) distal to the root end and then extends parallel towards the root end in a second region (9). The root portion (7) is configured to engage in a slot of the platform (1) with the first region (8) abutting a convergent wall portion (3) of the slot and the second region (9) spaced from a parallel wall (4) of the slot. At least one bore (11*a*, 12*a*) is provided in a parallel wall (4) of each slot and at least one bore (11*b*, 12*b*) is also provided in the second region of the root portion (7). The bores (11*a*, 11*b*; 12*a*, 12*b*) in the two components are positioned to align when a vane (2) is engaged in a slot. The aligning bores (11*a*, 11*b*; 12*a*, 12*b*) together are configured to receive a pin (13) for mechanically securing the vane in the slot. A braze joint (14) may be added between the root portion (7) and parallel slot walls 4.

8 Claims, 4 Drawing Sheets

(52) U.S. Cl.
CPC .... *F05D 2230/237* (2013.01); *F05D 2230/64* (2013.01); *F05D 2240/10* (2013.01); *F05D 2240/12* (2013.01); *F05D 2240/81* (2013.01); *F05D 2260/30* (2013.01)

(58) Field of Classification Search
USPC ..... 415/209.3
See application file for complete search history.

(56) References Cited

U.S. PATENT DOCUMENTS

| | | | | |
|---|---|---|---|---|
| 2014/0140834 | A1* | 5/2014 | Richner | F01D 9/042 415/191 |
| 2014/0314550 | A1* | 10/2014 | Jenkinson | F01D 9/042 415/148 |
| 2016/0177749 | A1 | 6/2016 | Brandl et al. | |
| 2017/0089209 | A1* | 3/2017 | Fentem | F01D 9/042 |
| 2017/0226887 | A1* | 8/2017 | Wulf | F01D 9/042 |
| 2018/0306042 | A1* | 10/2018 | Zaccardi | F02K 3/06 |

OTHER PUBLICATIONS

Feb. 12, 2018 Search Report issued in European Patent Application No. 17 19 1260.

* cited by examiner

STATOR ASSEMBLY FOR A GAS TURBINE ENGINE

TECHNICAL FIELD

The present disclosure relates to the joining of nozzle guide vanes of a turbine stator to a platform. More particularly the disclosure relates to joint arrangements which facilitate replacement of vanes joined to a platform.

BACKGROUND

A turbine stage consists of a rotor and a stator. In a rotor, a circumferential array of aerofoil blades is provided around a circumferential platform of a disc. The disc is mounted for rotation on a rotor shaft. The stator sits adjacent the rotor, upstream of the rotor, and typically comprises a pair of annular platforms in radial and concentric alignment, one platform having a greater diameter than the other. A circumferential array of guide vanes is provided to bridge an annular space between the annular platforms. Adjacent guide vanes form nozzles which serve to accelerate a working fluid towards the rotor.

It is known to join guide vanes to the annular platforms by brazing at junctions within the annular space, the annular space coinciding with an annulus through which the working fluid for the turbine is directed. Such joints are exposed to extreme temperatures and consequently may require shielding or cooling. Where such joints fail, their location within the annulus presents difficulties in accessing and repairing.

SUMMARY OF INVENTION

The present disclosure provides a stator assembly comprising at least one annular platform defining a boundary of an annulus and a plurality of guide vanes for arranging in a circumferential array on the annular platform;

the platform including a circumferential array of slots, each slot at a first end converging from an annulus facing side to an opposite side of the platform and then extending parallel towards a second end;

one or more cooling holes arranged in a wall of the slot;

each vane including a root portion which converges from a first region distal to the root end and then extends parallel towards the root end, the root portion configured to engage in a slot of the platform with the convergent portion abutting a convergent wall portion of the slot and the parallel portion spaced from the parallel wall of the slot; and at least one bore in a parallel wall of each slot and at least one bore in the parallel section of the root portion, the bore of parallel wall of the slot and the bore of the parallel section of the root portion positioned to align when a vane is engaged in a slot, the aligned bores together configured to receive a pin.

A braze joint may be provided between parallel walls of the root portion and the slot to secure the vane. The braze joint is preferably located adjacent the root end of the vane and extends only partly along the parallel portion. This presents an opportunity to machine off the brazed portion, a new braze joint may be provided on the remaining part of the parallel portion. A new bore may be drilled into the remaining parallel wall of the slot and parallel section of the root portion to accommodate a pin.

Optionally two or more sets of aligning bores are provided in the root portion and slot wall. These remove the need for an additional drilling operation when repairing a joint.

The assembly may comprise two annular platforms for arranging in radial and concentric alignment, one platform having a greater diameter than the other so as to define radially inner and outer walls of the annulus. Vanes may comprise a root portion at both ends allowing the vane to engage in both annular platforms whereby to bridge the annulus.

BRIEF DESCRIPTION OF DRAWINGS

An embodiment will now be described with reference to the accompanying figures in which.

DETAILS DESCRIPTION OF DRAWINGS AND SOME EMBODIMENTS

Figure 1:
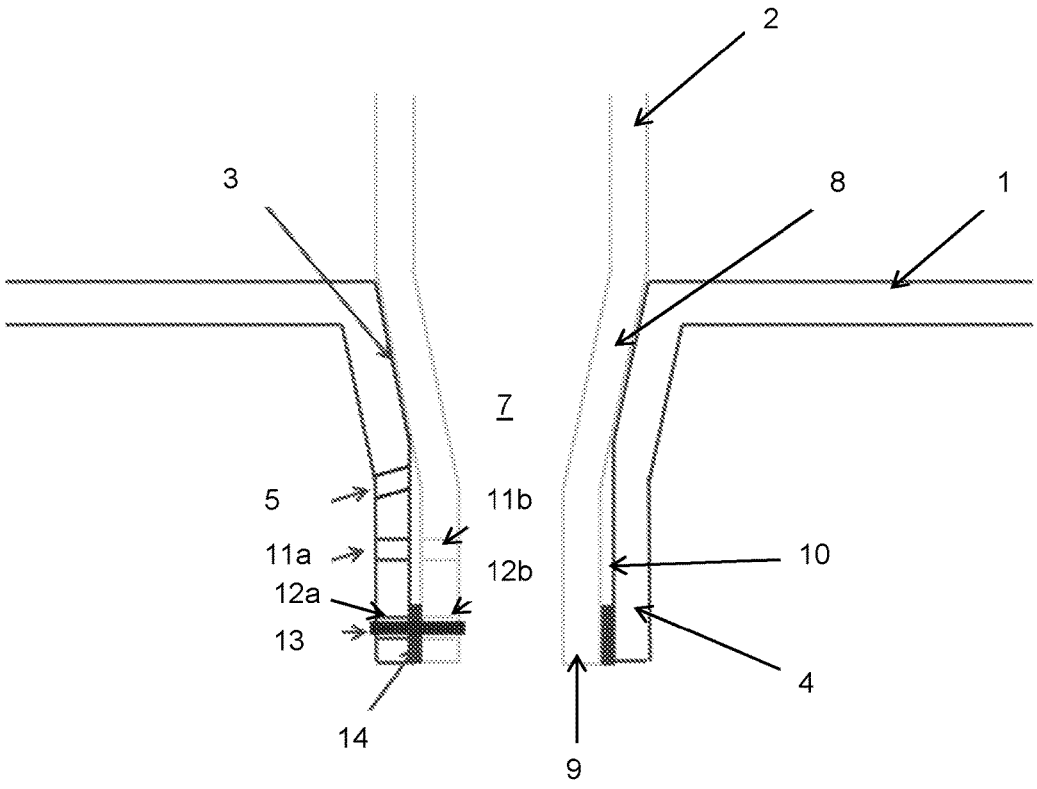
FIG. 1 illustrates an assembly in accordance with an embodiment of the invention.

As can be seen in FIG. 1 a platform 1 includes a slot for receiving a vane 2. Walls of the slot converge in a first region 3 and extend in parallel in a second region 4. A cooling hole 5 passes through the parallel wall 4 of the slot. The vane 2 has a root portion 7 which includes a converging portion 8 and a parallel portion 9. The converging portion 8 abuts the converging walls of the first region 3 of the slot and the parallel portion 9 extends into the parallel second region of the slot leaving a small space 10 between the parallel portion of the root and the parallel wall 4 of the slot. Two pairs of aligned bores 11*a*, 11*b*; 12*a*, 12*b* extend through the parallel walls. A pin 13 is located in the aligned bores 12*a*, 12*b* to mechanically lock the vane 2 into the slot. A braze joint 14 extends from an end of the space 10 towards but not as far as the aligned holes 11*a*, 11*b*. Cooling air delivered through cooling hole 5 is able to circulate through the reduced space and assists in keeping the braze joint 14 cool avoiding a possible loss in joint integrity when exposed to excessive heat.

Figure 2:
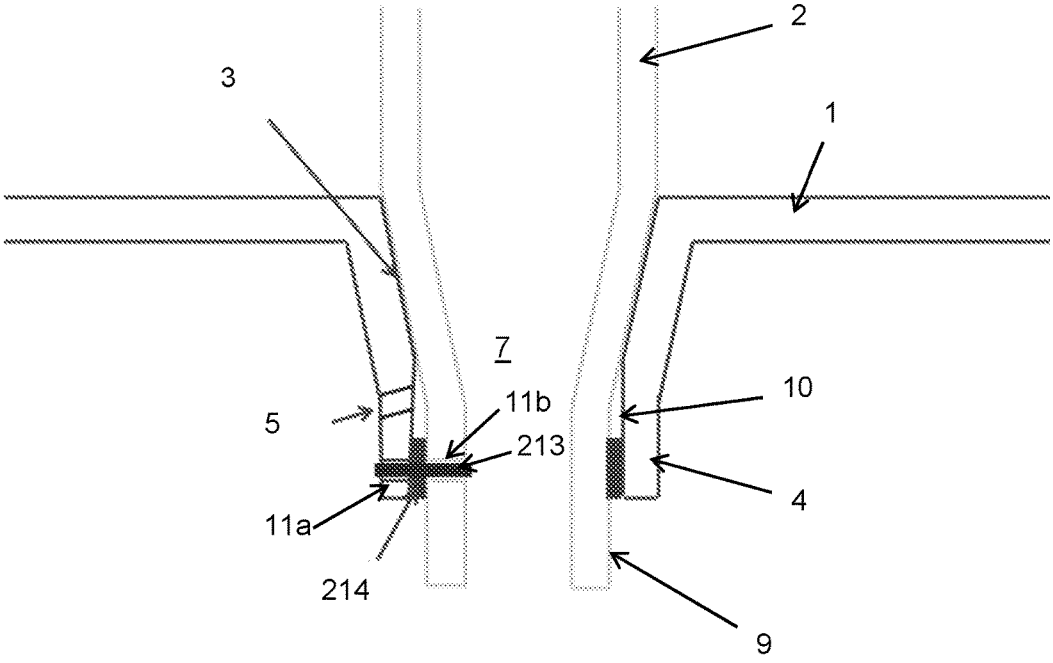
FIG. 2 illustrates the embodiment of FIG. 1 after repair.

If the braze joint 14 is damaged, the joint 14 can be conveniently removed by machining off an end of the parallel section of the slot. FIG. 2 shows the assembly just after the braze 14 has been removed. As can be seen, a new pin 213 is located in the previously vacant aligned bores 11*a*, 11*b*. The parallel portion 9 of the root 7 now extends beyond the shortened parallel wall 4 of the slot. A new braze joint 214 is provided in the remaining space 10.

Figure 3:
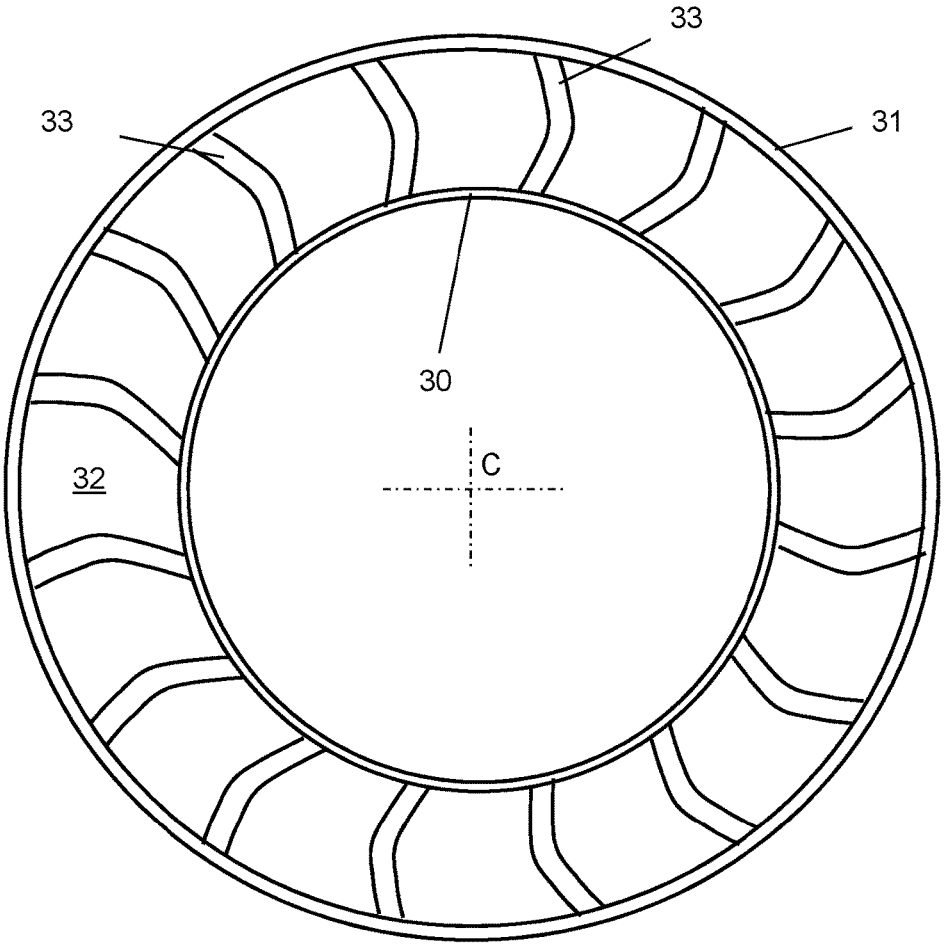
FIG. 3 illustrates a stator of a turbine stage showing positioning of components of the assembly.

FIG. 3 shows a schematic of a stator made from an assembly in accordance with the invention. As can be seen, the stator comprises a first, radially inner annular platform 30 and a second, radially outer annular platform 31. The platforms are radially and co-axially aligned on a centre C and are separated by an annular space 32. A plurality of vanes 33 is arranged in a circumferential array around the platforms 31, 32 and bridges the annular space 32.

Figure 4:
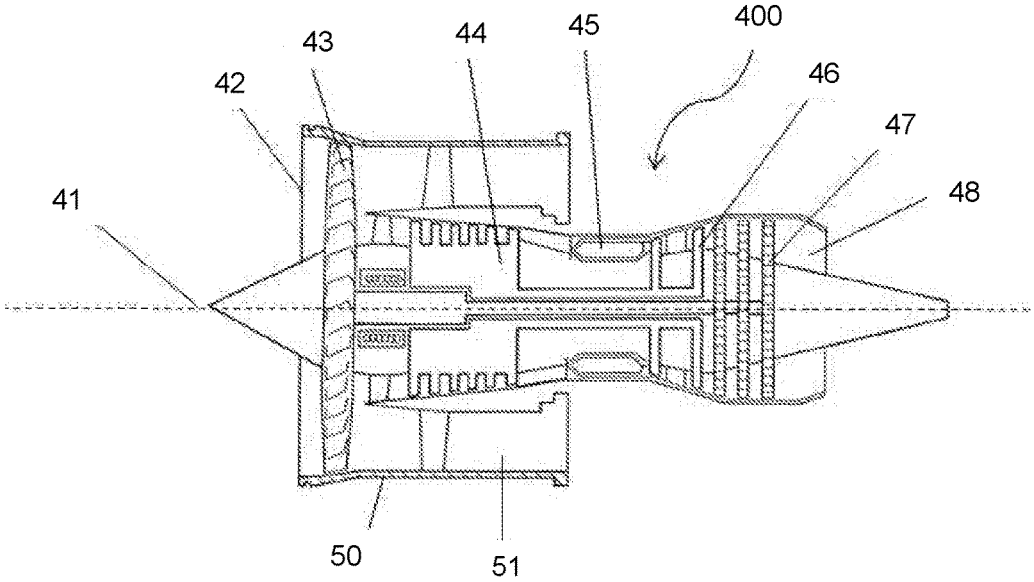
FIG. 4 illustrates a gas turbine engine in which a stator assembly in accordance with the invention might usefully be employed.

With reference to FIG. 4, a gas turbine engine is generally indicated at 400, having a principal and rotational axis 41. The engine 400 comprises, in axial flow series, an air intake 42, a propulsive fan 43, a high-pressure compressor 44, combustion equipment 45, a high-pressure turbine 46, a low-pressure turbine 47 and an exhaust nozzle 48. A nacelle 50 generally surrounds the engine 400 and defines the intake 42.

The gas turbine engine 400 works in the conventional manner so that air entering the intake 42 is accelerated by the fan 43 to produce two air flows: a first air flow into the high-pressure compressor 44 and a second air flow which passes through a bypass duct 51 to provide propulsive thrust. The high-pressure compressor 44 compresses the air flow directed into it before delivering that air to the combustion equipment 45.

In the combustion equipment 45 the air flow is mixed with fuel and the mixture combusted. The resultant hot combustion products then expand through, and thereby drive the high and low-pressure turbines 46, 47 before being exhausted through the nozzle 48 to provide additional propulsive thrust. The high 46 and low 47 pressure turbines drive respectively the high pressure compressor 44 and the fan 43, each by suitable interconnecting shaft.

A stator assembly in accordance with the invention may be incorporated in either of the turbine stages 46, 47.

Other gas turbine engines to which the present disclosure may be applied may have alternative configurations. By way of example such engines may have an alternative number of interconnecting shafts (e.g. three) and/or an alternative number of compressors and/or turbines. Further the engine may comprise a gearbox provided in the drive train from a turbine to a compressor and/or fan.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A stator assembly comprising at least one annular platform defining a boundary of an annulus and a plurality of guide vanes for arranging in a circumferential array on the annular platform;

the platform including a circumferential array of slots each slot at a first end having walls converging from an annulus facing side to an opposite side of the platform and then extending parallel towards a second end;

one or more cooling holes arranged in a wall of the slot;

each vane including a root portion which converges in a first region distal to the root end and then extends parallel towards the root end in a second region, the root portion configured to engage in a slot of the platform with the first region abutting a convergent wall portion of the slot and the second region spaced from a parallel wall of the slot; and at least one bore in a parallel wall of each slot and at least one bore in the second region of the root portion, the bores positioned to align when a vane is engaged in a slot, the aligning bores together configured to receive a pin.

2. A stator assembly as claimed in claim 1 wherein a braze joint is provided between parallel walls of the root portion and the slot to secure the vane.

3. A stator assembly as claimed in claim 1 comprising two annular platforms for arranging in radial and concentric alignment, one platform having a greater diameter than the other so as to define radially inner and outer walls of the annulus and wherein the vanes include a root portion at both ends.

4. A stator assembly as claimed in claim 1 wherein two or more sets of aligning bores are provided in the root portion and slot walls.

5. A stator vane configured for use in a stator assembly, the stator assembly being as described in claim 1.

6. An annular platform configured for use in a stator assembly, the stator assembly being as described in claim 1.

7. A turbine stage comprising an assembled stator assembly as claimed in claim 1 aligned coaxially with a turbine rotor.

8. A gas turbine engine comprising one or more turbine stages having the configuration set forth in claim 7.

* * * * *